US010485318B1

(12) United States Patent
Jenkins

(10) Patent No.: US 10,485,318 B1
(45) Date of Patent: Nov. 26, 2019

(54) HOT BRUSH AND COMB

(71) Applicant: Kenecia J. Jenkins, Wake Forest, NC (US)

(72) Inventor: Kenecia J. Jenkins, Wake Forest, NC (US)

( * ) Notice: Subject to any disclaimer, the term of this patent is extended or adjusted under 35 U.S.C. 154(b) by 649 days.

(21) Appl. No.: 14/707,491

(22) Filed: May 8, 2015

Related U.S. Application Data

(60) Provisional application No. 61/992,528, filed on May 13, 2014.

(51) Int. Cl.

| | |
|---|---|
| ***A45D 2/00*** | (2006.01) |
| ***A46B 15/00*** | (2006.01) |
| ***A46B 9/02*** | (2006.01) |
| ***A45D 1/04*** | (2006.01) |
| ***A45D 1/28*** | (2006.01) |

(52) U.S. Cl.
CPC ..... *A45D 2/002* (2013.01); *A45D 1/04* (2013.01); *A45D 1/28* (2013.01); *A46B 9/023* (2013.01); *A46B 15/003* (2013.01)

(58) Field of Classification Search
CPC ..... A46B 15/003; A46B 15/0095; A46B 15/0097; A46B 17/04; A46B 20/52; A46B 6/00; A45D 2/002; A45D 7/02; A45D 20/48; A45D 24/14; A45D 2/2471; A49D 1/00
USPC ..... 132/118, 143, 145
See application file for complete search history.

(56) References Cited

U.S. PATENT DOCUMENTS

| | | | | |
|---|---|---|---|---|
| 1,590,267 | A * | 6/1926 | Trester | A46B 7/02 15/185 |
| 2,446,236 | A * | 8/1948 | Morris | A45D 20/48 15/159.1 |
| 3,173,428 | A * | 3/1965 | Postel | A45D 1/18 132/118 |
| 3,927,684 | A | 12/1975 | Lam | |
| 4,126,143 | A | 11/1978 | Schroeder | |
| 4,217,915 | A * | 8/1980 | Gress | A45D 20/48 132/118 |
| 4,593,708 | A | 6/1986 | Goeller et al. | |
| 4,623,779 | A | 11/1986 | Raab | |
| 4,625,738 | A | 12/1986 | Skovdal et al. | |
| 4,702,265 | A | 10/1987 | Weddington | |
| 4,877,042 | A * | 10/1989 | Downey | A45D 1/04 132/212 |
| 6,363,215 | B1 | 3/2002 | Cafaro | |
| 6,393,718 | B1 * | 5/2002 | Harris | A45D 20/12 34/96 |
| 6,554,000 | B2 * | 4/2003 | Lin | A45D 1/04 132/229 |
| 7,797,782 | B2 * | 9/2010 | Davis | A45D 24/00 15/143.1 |

(Continued)

FOREIGN PATENT DOCUMENTS

WO WO2013171750 * 11/2013

*Primary Examiner* — Cris L. Rodriguez
*Assistant Examiner* — Brianne E Kalach
(74) *Attorney, Agent, or Firm* — Cramer Patent & Design, PLLC; Aaron R. Cramer

(57) ABSTRACT

An apparatus adapted to provide a hair brushing and combing device that supplies heat to the hair and scalp. The device has a generally flat bristle area with an underlying heating element. The apparatus includes varying length bristles and is heated by an internal element adapted to be powered by a standard power source.

1 Claim, 6 Drawing Sheets

(56) References Cited

U.S. PATENT DOCUMENTS

| | | | | |
|---|---|---|---|---|
| 2005/0011533 | A1* | 1/2005 | Ruben | A45D 1/28<br>132/230 |
| 2007/0193601 | A1* | 8/2007 | Tobias | A45D 1/12<br>132/224 |
| 2009/0193599 | A1* | 8/2009 | Stein | A46B 5/00<br>15/143.1 |
| 2012/0024734 | A1* | 2/2012 | Shaughness | A46B 17/04<br>206/361 |
| 2012/0186599 | A1* | 7/2012 | Schmid | A45D 7/02<br>132/210 |
| 2013/0247933 | A1* | 9/2013 | Oh | A45D 1/18<br>132/269 |

* cited by examiner

HOT BRUSH AND COMB

RELATED APPLICATIONS

The present invention was first described in and claims the benefit of U.S. Provisional Application No. 61/992,528 filed May 13, 2014, the entire disclosures of which are incorporated herein by reference.

FIELD OF THE INVENTION

The present invention relates to a flat iron having a plurality of bristles to entrain hair and apply the hair to the flat iron for conditioning and styling the hair through the application of heat.

BACKGROUND OF THE INVENTION

Hairstyles are numerous and often project nuances as unique as one's personality. As a consequence, in the world of hairstyling, there are literally thousands of styles from which to choose. One (1) popular tool used by many to style their hair is that of the flat iron. Historically, the flat iron was commonly used to straighten hair, add style, body, flips, flair, and the like in an efficient manner with minimal fuss. However, a traditional flat iron is limited in its styling capabilities due to the fact that it cannot "grab" the hair similar to that of a comb or brush. Rather, it can only straighten the hair it comes into contact with and thus leaves many people looking for an additional styling tool to complete their hairstyle.

In those instances where a flat iron is insufficient, people must frequently resort to using separate tools like curling irons or curling brushes. Such a requirement often adds precious time to a hectic morning routine or getting ready for an evening engagement. Accordingly, there exists a need for a means by which hair can be straightened and styled in a manner that addresses the shortcomings as described above. The development of the hot brush and comb fulfills this need.

SUMMARY OF THE INVENTION

The inventor has recognized the aforementioned inherent problems and lack in the art and observed that there is a need for a hot brush and comb device.

It is therefore an object of the invention to provide a hair styling instrument comprising a hollow casing configured to form a handle and a brush head having a front face and a rear surface. The brush head has an opening disposed on the front face. A conditioning plate is disposed within the casing and protrudes through the opening. The conditioning plate comprises a planar bar which has a roller portion disposed on a top surface and a plurality of bristles extending from the bar top surface. The conditioning plate also has a resistive heat plate disposed within the casing and lying adjacent to the conditioning plate, a heating element disposed within the casing and lying adjacent to the resistive heat plate, a control and display panel disposed on a surface of the casing and in electrical communication with the heating element, a power cord extending from the handle and in electrical communication with the heating element and the control and display panel and a switching assembly disposed within the casing and in electrical communication with the heating element, the control and display panel, and the power cord.

The control and display panel comprises a plurality of pushbuttons in operable connection with a plurality of contact switches in electrical communication with the switching assembly configured to receive selective manual input. The control and display panel provides data read-outs from a plurality of temperature sensors each in electrical communication with the switching assembly. The switching assembly selectively transmits electrical power from the power cord to the heating element and the control and display panel based upon the manual input.

The plurality of the temperature sensors are each configured to provide a temperature reading of the resistive heat plate. The switching assembly is further configured to use each temperature reading as feedback to permit and disrupt the transmission of electrical power. A timer is in electrical communication with the switching assembly and configured to automatically disrupt the transmission of electrical power upon experiencing a predetermined lapse of time. The timer comprises a mode preset for a predetermined period of time at a temperature as high as the heating element is able to provide.

The mode is only accessible when the cover plate is secured in a closed position by the fastening mechanism and verified by the pressure sensor. A finger grip is disposed on an upper portion of the brush head. A hand grip is disposed around the handle. The finger grip is coated in a high friction material. The hand grip is coated in a high friction material. A stand is pivotally attached to the rear surface residing within a recess when in a stowed position and configured to prop the instrument at an angle. A retention mechanism is employed to temporarily retain the stand when in the stowed position.

The power cord further comprises a cord retractor configured to permit extension of a length of the power cord and automatically retract and store the length. A locking mechanism is configured to selectively prevent the automatic retraction of the power cord. Each bristle further has a knob disposed on a top portion thereof. The knob is heat insulative.

A cover plate is configured to cover and protect the conditioning plate and the plurality of bristles. A hinged connection pivotally affixes the cover plate to the casing. The hinged connection permits the rotation of the cover plate to selectively cover the conditioning plate. The hinged connection is further configured to permit selective removal of the cover plate. The cover plate is provided with at least one ventilation aperture. A fastening mechanism is disposed on the casing to temporarily secure the cover plate to the casing when rotated to cover the conditioning plate. A pressure sensor is disposed within the fastening mechanism and configured to provide a pressure reading of the fastening mechanism.

The switching assembly is further configured to use the pressure reading as feedback to permit and disrupt the transmission of electrical power. The conditioning plate and each bristle are comprised of titanium. The handle and the brush head are integrally molded. The brush head is wider than the handle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
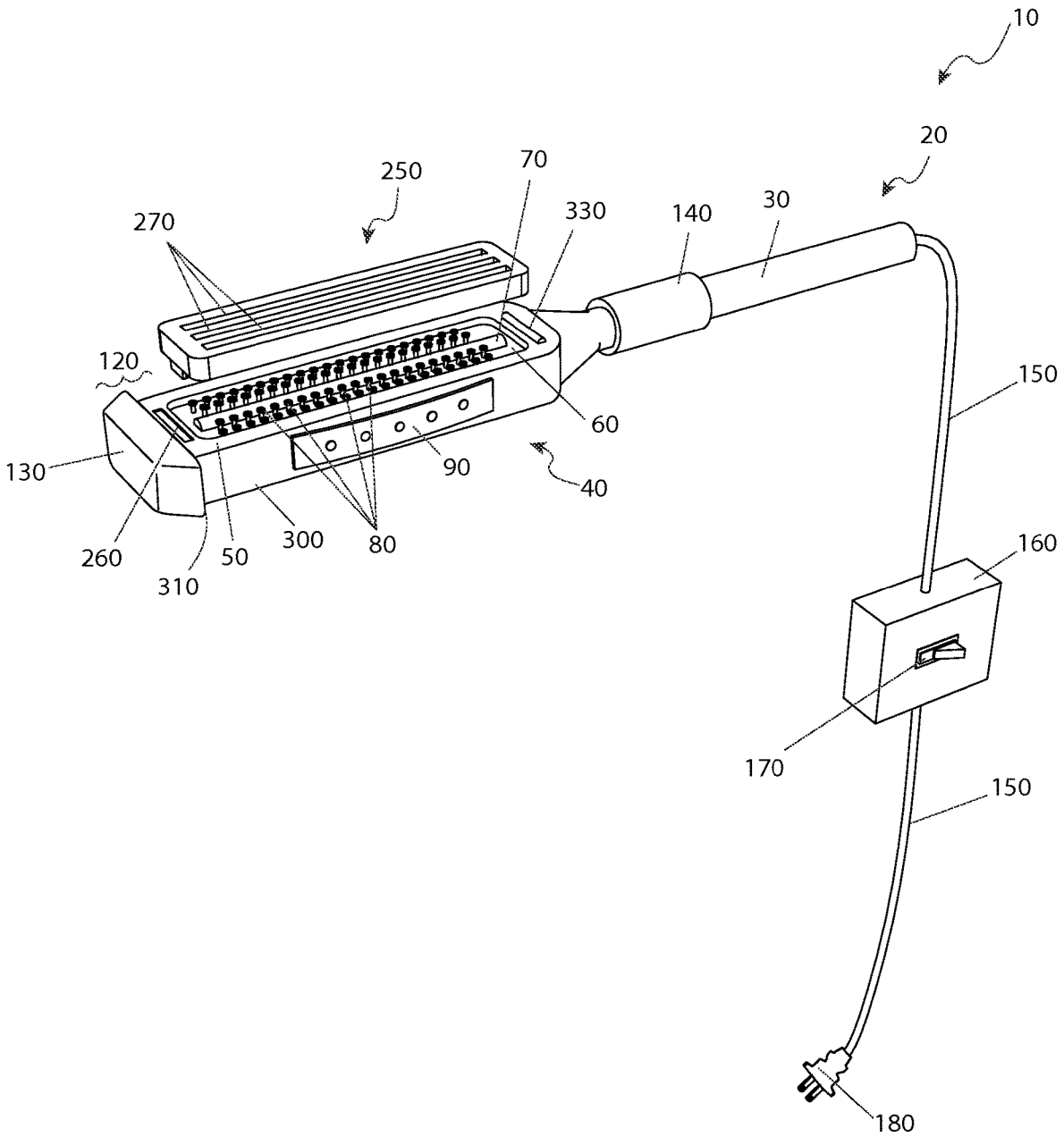
FIG. 1 is a perspective front view of a hair styling instrument 10, in accordance with the preferred embodiment of the present invention.

10 hair styling instrument
20 brush
30 handle
40 brush head
50 front face
60 conditioning plate
70 roller portion
80 bristle
90 control and display panel
100 stand
110 heating element
120 top
130 finger grip
140 hand grip
150 power cord
160 cord retractor
170 locking mechanism
180 plug end
190 resistive heat plate
200 switching assembly
210 temperature sensor
220 timer
240 retention mechanism
250 cover plate
260 fastening mechanism
270 ventilation aperture
280 pressure sensor
290 casing
300 lateral side
310 rear surface
320 recess
330 hinged connection
405 hand
410 user
415 hair
420 travel path "T"
425 rotational motion "R"

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hair styling instrument (herein referred to as the "device") 10, further having a brush 20 with a conditioning plate 60 having a plurality of bristles 80, which provides a means to entrain hair for conditioning and styling the hair 415 through the application of heat supplied by a resistive heat plate 190.

Figure 2:
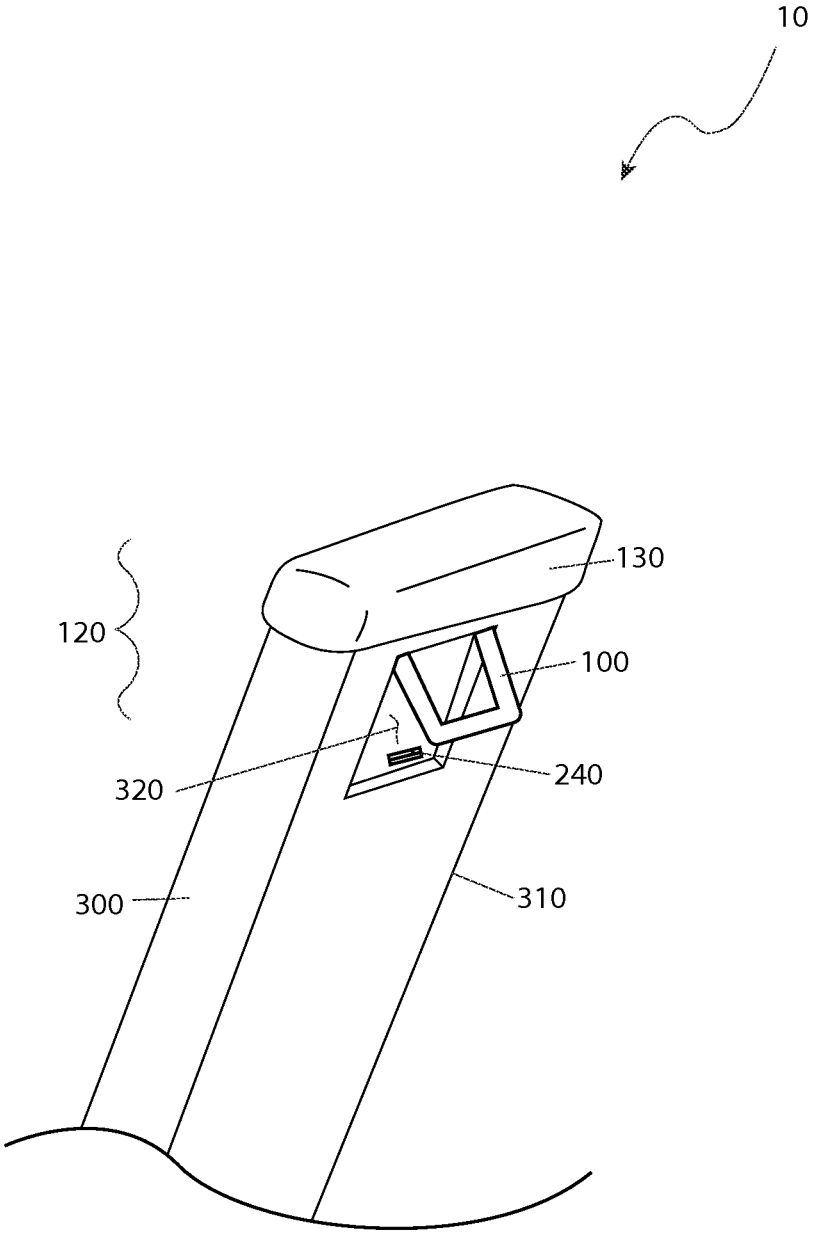
FIG. 2 is a partial perspective rear view of the device 10 showing the stand 100 rotated in a deployed position, in accordance with the preferred embodiment of the present invention.
Figure 3:
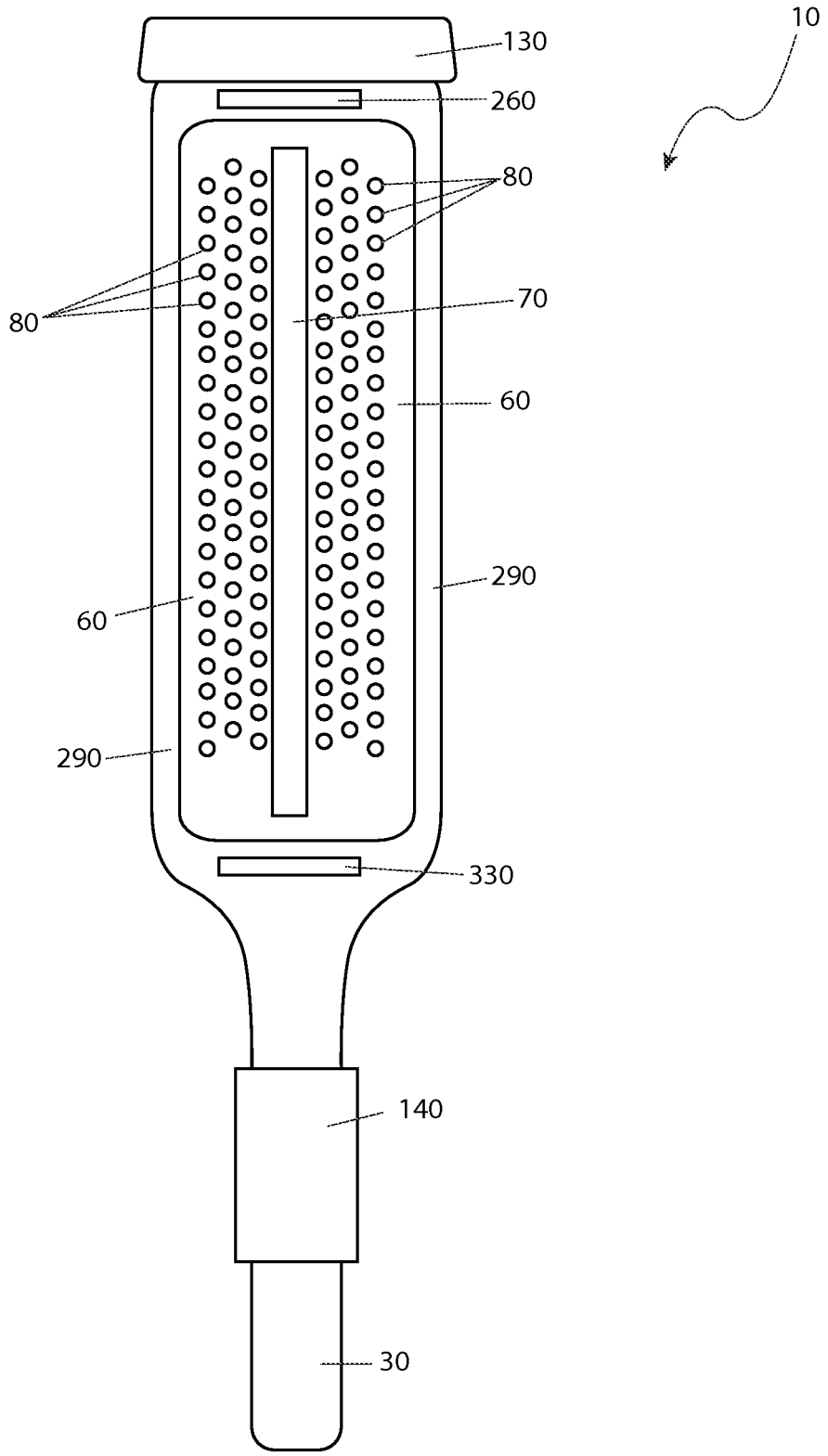
FIG. 3 is a front view of the device 10, in accordance with the preferred embodiment of the present invention.

Referring now to FIGS. 1, 2, and 3 a perspective front view, a partial perspective rear view, and a frontal view of the device 10, in accordance with the preferred embodiment of the present invention, are disclosed. The device 10 comprises a brush 20 having a handle 30 and a brush head 40. The brush 20 has a casing 290 that houses the electronic and heating components of the device 10. A front face 50 of the brush head 40 has a conditioning plate 60, which is applied to a user's hair 415 for conditioning and styling. This conditioning plate 60 is further provided with a roller portion 70, and is equipped with a plurality of bristles 80 protruding from a surface thereof. The roller portion 70 is specifically intended to create a curl at the distal end of the user's hair 415. A control and display panel 90 is disposed on a surface of the casing 290, preferably on a lateral side 300 of the brush head 40 or a rear surface 310 of the brush head 40. A stand 100 located on a rear surface 310 of the brush head 40 props the device 10 up at an angle when it is laid on its rear surface 310 so as to provide an easy means to grasp the device 10 while reducing the risk of being burned by inadvertently touching the conditioning plate 60. A resistive heat plate 190 is coupled to the conditioning plate 60 and provides controlled heat thereto so that a user may exploit the heating effects of the device 10 to condition and style their hair 415.

The brush 20 is preferably configured as an elongated handle 30 leading to an integrally molded brush head 40 that is wider than that of the handle 30 so as to provide greater surface area upon which a user's hair 415 makes contact with the conditioning plate 60, thereby optimizing efficient use thereof; however, other configurations may be utilized without deviating from the teachings of the device 10. The casing 290 of the brush 20 is a hollow structure and preferably light-weight plastic. A top 120 portion of the brush head 40 has a finger grip 130 that provides a high friction surface for a user's fingers to pinch, or otherwise grasp onto, while employing the device 10. A portion of the handle 30 is further provided with hand grip 140 having a similar high friction surface to accommodate the same. Each grip 130, 140 is preferably a rubber or polymer material disposed onto the casing 290 of the brush 20; however, the grips 130, 140 may also be molded into the casing 290 or even be a textured surface of the casing 290.

Extending from a portion of the handle 30 is a power cord 150, which is configured to transmit electrical power from an ancillary electrical power supply to the electronics of the device 10. In electrical connection with the power cord 150, and disposed within the handle 30, are the necessary transformers and inverters to configure the electrical power to a proper amperage and voltage for operable transmission to the electronics and safe operation of the device 10.

In an alternative embodiment of the invention, the power cord 150 is further provided with a cord retractor 160. The cord retractor 160 automatically winds the power cord 150 within the cord retractor 160 for neat and compact storage of the power cord 150. Yet, the plug end 180 may be extended from the cord retractor 160 to increase the reach-length of the power cord 150. The cord retractor 160 is further provided with a locking mechanism 170 to selectively prevent retraction of the power cord 150 and maintain a desired reach-length. It is envisioned for the retracting means of the cord retractor 160 to comprise a cord drum (not shown) rotatingly secured to reel (not shown). The power cord 150 is affixed to the reel and wound about the drum. A spring (not shown) is configured to apply a force, tending to rotate the reel in a direction such that the power cord 150 is wound about the drum. While it is envisioned for the retracting means to be as described above, retractable electrical extension cord devices are common in the art and are available in several forms. The force to rotate the drum or reel may be a simple hand crank or a spring-loaded ratchet mechanism, which are mechanically engaged with, or even incorporated into, the drum or reel, such as disclosed and described in U.S. Pat. Nos. 1,904,000 and 5,701,981.

Figure 4:
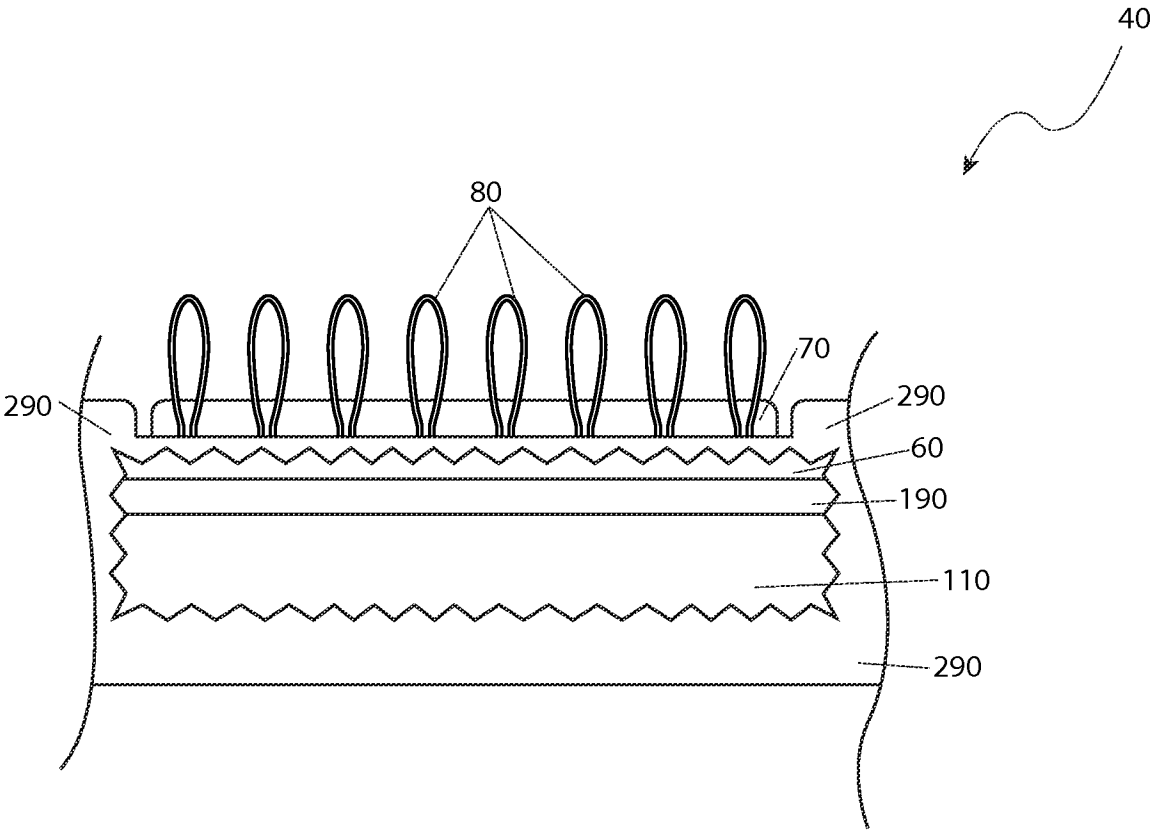
FIG. 4 is a cut-away partial side view of the brush head 40, in accordance with the preferred embodiment of the present invention.
Figure 5:
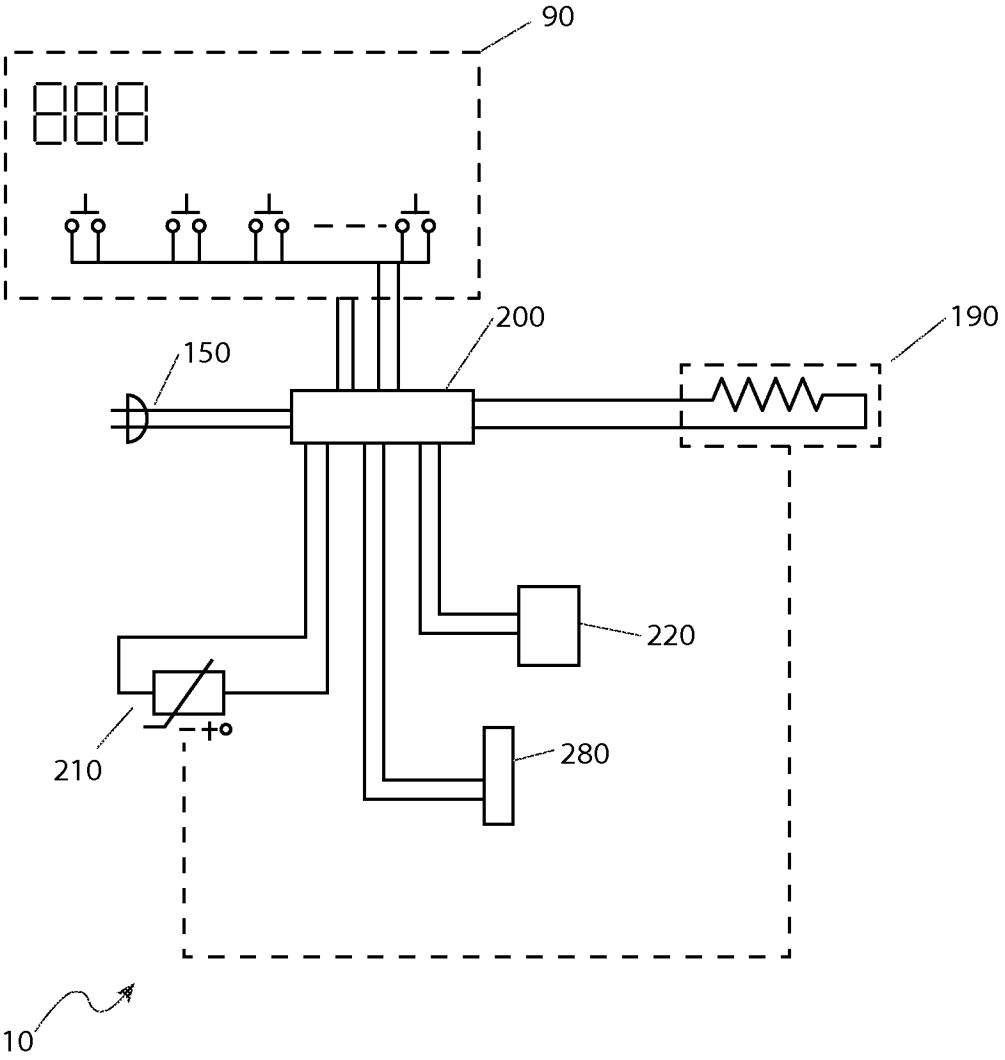
FIG. 5 is an electro-mechanical schematic of the device 10, in accordance with the preferred embodiment of the present invention; and, FIG. 6 is a perspective view of the device 10, shown in a utilized state, in accordance with the preferred embodiment of the present invention.

Referring now to FIGS. 4 and 5, a cut-away partial side view of the brush head 40 and an electro-mechanical schematic of the device 10, in accordance with the preferred embodiment of the present invention, are disclosed. The power cord 150 is in electrical communication with a resistive heat plate 190 via a switching assembly 200. The switching assembly 200 is an electrical circuit in connection with the control and display panel 90, and is configured to open and close electrical switching based upon manual inputs of the control and display panel 90. The switching assembly 200 is further provided with temperature sensors 210 that communicate to the control and display panel 90 the temperature of the resistive heat plate 190 portion of the heating element 110. The switching assembly 200 is further configured to automatically disrupt electrical power transfer from the power cord 150 to the resistive heat plate 190 when the temperature obtains a certain threshold temperature set by a user via the control and display panel 90. The control and display panel 90 is provided with pushbuttons in operable connection with contact switches leading to the switching assembly 200. An LCD display provides for data readouts from the temperature sensors 210. The pushbuttons are envisioned to comprise an ON/OFF button and a temperature selection button, where the LCD display informs a user when the device 10 is "ON" and "OFF". The LCD display also informs the user of the temperature of the heat plate 190. The temperature selection, and display thereof, may be actual temperature values or proxy settings such as "1", "2", "3" or "H", "M", "L". It is further envisioned for a solid state timer 220 to be incorporated into the switching assembly 200 to automatically disrupt electrical power transfer to the resistive heat plate 190 after experiencing a predetermined elapse of time so as to prevent a user from inadvertently leaving the device 10 "ON".

A printed circuit board (not shown) abuts a face of the control and display panel 90, which is in connection with the switching assembly 200. The switching assembly 200 comprises in the preferred embodiment at least one pushbutton switch on a printed circuit board. The pushbuttons overlay the printed circuit board and are separated by conductive pads, but an individual pushbutton makes contact with the printed circuit board when the pushbutton is depressed, thereby creating an electrical connection between the pushbutton and the switching assembly 200. The printed circuit board is provided with pushbutton switch elements (not shown) that are aligned with, and operated by, the pushbuttons and switches of the switching assembly 200. The printed circuit board is also in electrical communication with the LCD display. The conductive pads bias each pushbutton in a direction away from the pushbutton switch element, yet actuation of a pushbutton closes a respective pushbutton switch element, thereby creating an electrical signal between the pushbuttons, switching assembly 200, and LCD display.

As described above, the power cord 150 is configured to transfer electrical power to the resistive heat plate 190. The resistive heating plate 190 comprises a heat conductive metal having a heating element 110 disposed on a bottom surface thereof. The heating element 110 is a plurality of electrical resistors arranged to generate heat as electric current from the power cord 150 is passed through them. As heat is generated, it is transferred to the conductive metal. In physical contact with the conductive metal, preferably on a top surface thereof, is the conditioning plate 60 so that heat is transferred from the conductive metal to the conditioning plate 60. The conductive metal is envisioned to be a metal having a high heat transfer coefficient, and be a planar bar substantially matching a shape and surface area of the bottom surface of the conditioning plate 60 so as to effectively transfer an even amount of heat to all areas of the conditioning plate 60. However, because it is envisioned for the conditioning plate 60 to have some contour and varying thickness (as will be described later), the conductive plate may comprise of varying thicknesses or composite metals exhibiting differentials in heat transfer so as to either maintain a constant heat transfer to the entire conditioning plate 60, or even a differential heat transfer with respect to different areas of the conditioning plate 60, if it is so desired.

The conditioning plate 60 is secured within the casing 290 so as to be exposed at the front face 50. The conditioning plate 60 comprises a metal plate, preferably titanium, with a plurality of metal bristles 80, each preferably titanium, protruding from a top surface thereof. The conditioning plate 60 may have a flat planar top surface or arcuate surface; however, a central longitudinal portion of the top surface is provided with a semi-circular projection forming the roller portion 70. The bristles 80 are of a uniform length and are comprised of loops which serve to entrain hair to force it against the conditioning plate 60 and to prevent scalding the scalp due to the heat being generated in the conditioning plate 60 and bristles 80. Additionally, the looped bristles 80 are envisioned to facilitate cleaning excess hair strands 415 from the apparatus 10. In a preferred embodiment, no bristles 80 are disposed over the roller portion 70; however, it is envisioned for bristles 80 to also be protruding from the roller portion 70 for specific conditioning and styling of a user's hair 415.

A rear surface 310 of the brush head 40 is provided with a pivotally attached stand 100, which is preferably attached to the casing 290 within a recess 320 of the brush head 40 so that when the stand 100 is pivoted to a stowed position, it does not protrude from a surface of the casing 290. The stand 100 is envisioned to comprise a metal angled bar and configured to prop the device 10 at an angle when the device 10 is laid on its rear surface 310 and the stand 100 is deployed. The recess 320 may also be provided with a retention mechanism 240 to temporarily keep the stand 100 in a stowed state until it is physically rotated to a deployed state.

A cover plate 250 is hingedly affixed to a top surface of the brush head 40 and is configured to selectively cover and protect the conditioning plate 60 and bristles 80. Although the hinged connection 330 is shown near the handle 30, it is understood that the hinged connection 330 may be anywhere along the front face 50 of the brush head 40. A fastening mechanism 260 is preferably located at an opposing end of the hinged connection 330 to removably secure the cover plate 250 in a closed position over the conditioning plate 60. The hinged connection 330 is further configured to enable selective removal of the cover plate 250 from the brush head 40, if it is desired to do so. A surface of the cover plate 250 is provided with at least one (1) ventilation aperture 270, which may be circular, elongated slots, or another shape.

An alternative embodiment of the invention is provided with a self-cleaning mode. The self-cleaning mode increases the temperature of the conditioning plate 60 as high as the heating elements 110 can provide for an extending period of time. The timer 220 in this mode is preset for a time period conducive to burning off hair 415 and hair products from the conditioning plate 60. This self-cleaning mode is only accessible when the cover plate 250 is locked into a closed position by the fastening mechanism 260. This is achieved via a pressure sensor 280 disposed within the fastening mechanism 260 and in electrical communication with the switching assembly 200 so as to communicate to the switching assembly 200 that the cover plate 250 is fastened in a closed position.

Figure 6:
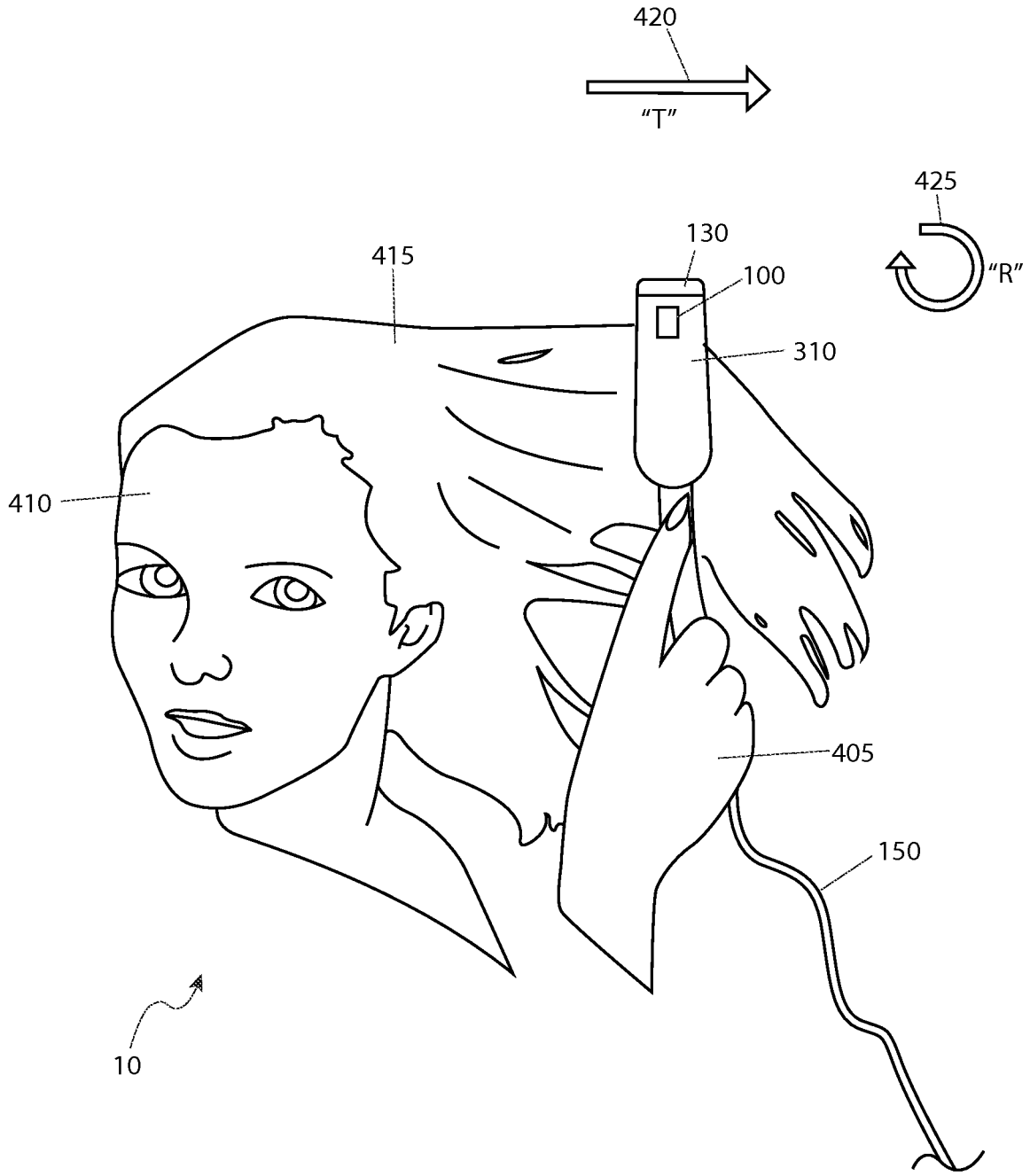

Referring finally to FIG. 6, the apparatus 10 is shown in a utilized state in accordance with the preferred embodiment of the present invention. The apparatus is held in the hand 405 of the user 410 in much the same manner as a conventional brush or comb. The power cord 150 hangs free from the hand 405 as depicted so as to not interfere with hair styling process. Following the same process as a conventional comb or brush, the user moves the apparatus 10 the hair 415 using two (2) different motions. The first motion follows a travel path "T" 420 which provides for general smoothing and/or straightening of the hair 415. An alternate rotational motion "R" 425 can be used to impart curl and/or body to the hair 415. Said motion along the travel path "T" 420 and the rotational motion "R" 425 can be used separately or simultaneously with the proximal end of the hair 415 being straightened or smoothed and the distal end of the hair 415 being curled to enhance aesthetic styling. Also visible in FIG. 6 is the rear surface 310 of the apparatus 10 along with the stand 100 and finger grip 130.

It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention can be utilized in a simple and straightforward manner with little or no training After initial purchase or acquisition of the device 10, it would be configured as indicated in FIG. 1.

The method of utilizing the device 10 may be achieved by performing the following steps: acquiring a model of the device 10; ensuring that the control and display panel 90 indicates that the device 10 is in an "OFF" state; extracting the power cord 150 from the cord retractor 160, if an extension of length is required, by releasing the power cord 150 via actuation of the locking mechanism 170 and pulling the power cord 150; plugging the plug end 180 into an electrical socket to receive electrical power; pivotally opening the cover plate 250, or removing the cover plate 250; positioning the stand 100 in a deployed state; turning the device 10 "ON" and setting it to a desired temperature setting via manual inputs through the control and display panel 90; laying the device 10 on its rear surface 310 so that it rests upon the stand 100; wait for the resistive heat plate 190 to impart enough heat to the conditioning plate 60 so that the LCD display 90 indicates that a desired temperature level has been attained; lifting the device 10 from its laid-down position and stowing the stand 100; grasping the device 10 at the handle 30, as well as the finger grip 130 and hand grip 140 portions if they provide a more salutary grasp; employing the device 10 to entrain hair 415 through the bristles 80 so that hair 415 is pressed against the roller portion 70, the conditioning plate 60, and bristles 80, thereby imparting hair 415 with heat conditioning; stroking repeatedly the hair 415 to style the hair 415 in a desire fashion by using the travel path "T" 420 and the rotational motion "R" 425; deploying the stand 100 when finished styling the hair 415; replacing the cover plate 250 and locking it in a closed position with the fastening mechanism 260; setting the control and display panel 90 to self-cleaning mode; laying the device 10 on its back and allowing for the self-cleaning mode to burn off residual hair 415 and hair products; and, allowing the timer 220 to automatically place the device 10 in an "OFF" state when a predetermine amount of time has elapsed.

The invention claimed is:

1. A hair styling instrument, comprising:

a hollow casing to form a handle and a brush head having a front face, a top portion, and a rear surface, wherein said brush head has an opening disposed on said front face and said top portion of said brush head has a finger grip that provides a high friction surface for a user's fingers to pinch, or otherwise grasp onto, while employing said hair styling instrument, a portion of said handle is further provided with a hand grip having a similar high friction surface to accommodate a high friction surface for a user's fingers to pinch, or otherwise grasp onto, while employing said hair styling instrument;

a conditioning plate disposed within said casing protruding through said opening, comprising:

a planar bar having a roller portion disposed on a top surface thereof;

a plurality of bristles extending from said bar top surface;

a resistant heat plate disposed within said casing lying adjacent to said conditioning plate;

a heating element disposed within said casing lying adjacent to said resistant heat plate;

a control display panel disposed on a surface of said casing in electrical communication with said heating element;

a power cord extending from said handle in electrical communication with said heating element and said control display panel, comprising:

a cord retractor to permit extension of a length of said power cord automatically retract and store said length;

a locking mechanism to selectively prevent said automatic retraction of said power cord;

a switching assembly disposed within said casing in electrical communication with said heating element, said control display panel, and said power cord;

a retention mechanism to temporarily retain said stand when in said stowed position;

a timer in electrical communication with said switching assembly to automatically disrupt said transmission of electrical power upon experiencing a predetermined lapse of time;

a stand pivotally attached to said rear surface residing within a recess when in a stowed position to prop said instrument at an angle;

a cover plate to cover and protect said conditioning plate and said plurality of bristles, wherein each bristle further has a knob disposed on a top portion thereof and said knob is heat insulative;

a fastening mechanism disposed on said casing to temporarily secure said cover plate to said casing when rotated to cover said conditioning plate;

a pressure sensor disposed within said fastening mechanism to provide a pressure reading of said fastening mechanism, wherein said switching assembly is further to use said pressure reading as feedback to permit and disrupt said transmission of electrical power;

wherein said control display panel comprises a plurality of pushbuttons in operable connection with a plurality of contact switches in electrical communication with said switching assembly to receive selective manual input;

wherein said control display panel provides data read-outs from a plurality of temperature sensors each in electrical communication with said switching assembly;

wherein said switching assembly selectively transmits electrical power from said power cord to said heating element and said control display panel based upon said manual input;

wherein said plurality of said temperature sensors are each to provide a temperature reading of said resistant heat plate;

wherein said switching assembly is further to use each temperature reading as feedback to permit and disrupt said transmission of electrical power;

a hinged connection pivotally affixing said cover plate to said casing;

wherein said hinged connection permits rotation of said cover plate to selectively cover said conditioning plate;

wherein said hinged connection permits selective removal of said cover plate;

wherein said cover plate is provided with at least one ventilation aperture;

wherein said timer comprises a mode preset for a predetermined period of time at a temperature as high as said heating element is able to provide; and wherein said mode is only accessible when said cover plate is secured in a closed position by said fastening mechanism verified by said pressure sensor.

* * * * *